US007992766B2

(12) United States Patent
Seo

(10) Patent No.: US 7,992,766 B2
(45) Date of Patent: Aug. 9, 2011

(54) PAPER CUP WITH HAND GRIP

(76) Inventor: Mi Soo Seo, Seoul (KR)

( * ) Notice: Subject to any disclaimer, the term of this patent is extended or adjusted under 35 U.S.C. 154(b) by 0 days.

(21) Appl. No.: 12/900,327

(22) Filed: Oct. 7, 2010

(65) Prior Publication Data

US 2011/0017815 A1 Jan. 27, 2011

Related U.S. Application Data

(63) Continuation of application No. PCT/KR2009/005817, filed on Oct. 12, 2009.

(30) Foreign Application Priority Data

Jan. 30, 2009 (KR) ..... 20-2009-001021 U

(51) Int. Cl.
*B65D 3/28* (2006.01)
*B65D 5/465* (2006.01)

(52) U.S. Cl. ..... 229/402; 229/117.22; 229/117.23

(58) Field of Classification Search ..... 229/117.22, 229/117.23, 402, 160.2, 920; 206/752, 763, 206/764, 767, 770; 220/752, 763, 764, 767, 220/770

See application file for complete search history.

(56) References Cited

U.S. PATENT DOCUMENTS 1,986,927 A * 1/1935 Hanson ..... 229/402
2,082,005 A * 6/1937 Jenett ..... 229/402
2,641,403 A * 6/1953 Buttery et al. ..... 229/402
2,659,527 A * 11/1953 Liebenow ..... 229/402
2,868,434 A * 1/1959 Jones ..... 229/402
3,151,798 A * 10/1964 Meagher ..... 220/23.83
3,387,762 A * 6/1968 Zupon ..... 229/120.02
3,926,361 A * 12/1975 Hilderbrand ..... 229/402
4,102,454 A * 7/1978 Karevaara ..... 206/514
4,685,583 A * 8/1987 Noon ..... 220/710.5
4,712,728 A * 12/1987 Schuster ..... 229/117.13

(Continued)

FOREIGN PATENT DOCUMENTS

JP 6048474 U 7/1994

(Continued)

OTHER PUBLICATIONS

International Search Report and Written Opinion of the International Searching Authority; PCT/KR2009/005817; May 18, 2010; 5 pages.

*Primary Examiner* — Gary E Elkins
(74) *Attorney, Agent, or Firm* — St. Onge Steward Johnston & Reens LLC

(57) ABSTRACT

A paper cup with a hand grip has a cylindrical cup body with an open upper end to accommodate beverages and a hand grip attached to an outer wall of the cup body and a pair of ring-shaped portions. The ring-shaped portions are symmetrically disposed on right and left ends of the contact portion and each include a through hole through which a user puts a finger when grasping the hand grip. The ring-shaped portions are movable between a first position where they are attached to the outer wall of the cup body and a second position where the ring-shaped portions face each other. In this way the paper cup can be stably and conveniently grasped to prevent a beverage in the paper cup from being shaken and overflowing, even when a hot or cold beverage is filled in the paper cup.

3 Claims, 4 Drawing Sheets

U.S. PATENT DOCUMENTS

| | | | | |
|---|---|---|---|---|
| 6,116,503 | A * | 9/2000 | Varano | 229/403 |
| 6,186,395 | B1 * | 2/2001 | Kennett | 229/402 |
| 6,527,169 | B2 * | 3/2003 | Kim | 229/402 |
| 6,592,024 | B2 * | 7/2003 | Laker et al. | 229/160.2 |
| 2002/0148888 | A1 * | 10/2002 | Kim | 229/402 |
| 2010/0213205 | A1 * | 8/2010 | Kang | 220/737 |

FOREIGN PATENT DOCUMENTS

| | | | |
|---|---|---|---|
| JP | 2004091012 | A | 3/2004 |
| KR | 2019890012506 | U | 8/1989 |
| KR | 2019930017696 | U | 8/1993 |

* cited by examiner

PAPER CUP WITH HAND GRIP

CROSS-REFERENCE TO RELATED APPLICATIONS

The present application is a continuation of pending International patent application PCT/KR2009/005817 filed on Oct. 12, 2009 which designates the United States and claims priority from Korean patent application 20-2009-0001021 filed on Jan. 30, 2009, the content of which is incorporated herein by reference.

FIELD OF THE INVENTION

The present invention relates to a paper cup with a hand grip, and more particularly, to a paper cup with a hand grip that can be stably and conveniently grasped to prevent a beverage in the paper cup from being shaken and overflowing from the paper cup even when a hot or cold beverage is filled in the paper cup.

BACKGROUND OF THE INVENTION

Generally, paper cups are widely used when selling coffee or juice via beverage vending machines or in coffee shops. A paper cup usually includes a cylindrical cup body for accommodating a beverage and a curling portion disposed at a top end of the cylindrical cup body in order to protect the user's lips and maintaining the curled shape of the cup body.

However, when hot coffee or cold juice is filled in a conventional paper cup, due to heat of hot coffee or chill of cold juice, the user cannot stably grasp the paper cup with his/her hand. Thus, an additional insulation band is placed around the cup body when selling hot coffee or cold juice.

Also, when the user grasps the cup body, the cup body may slip from the user's hand.

SUMMARY OF THE INVENTION

The present invention provides a paper cup with a hand grip having an improved structure so that a user may stably and conveniently grasp the hand grip to prevent a beverage accommodated in the paper cup from being shaken and overflowing from the paper cup.

According to an aspect of the present invention, there is provided a paper cup with a hand grip, the paper cup accommodating a beverage and a user grasping the paper cup when drinking the beverage, the paper cup including: a cylindrical cup body of which upper end is opened and which accommodates the beverage poured from the opened upper portion; and the hand grip including a contact portion attached to an outer wall of the cup body and a pair of ring-shaped portions, wherein the pair of ring-shaped portions are symmetrically disposed on right and left ends of the contact portion and each include a through hole through which a user puts a finger when grasping the hand grip, wherein the pair of ring-shaped portions are movable between a first position where the ring-shaped portions are attached to the outer wall of the cup body and a second position where the hand grip is bent along the bending line formed at a boundary between the contact portion and the pair of ring-shaped portions so that the ring-shaped portions face each other, and the paper cup further including an attachment unit for attaching the pair of ring-shaped portions to each other when the pair of ring-shaped portions are in the second position, and wherein a groove portion is formed in a top end of the cup body, and protrusions are formed in top ends of the pair of ring-shaped portions, and the protrusions can be inserted in the groove portion so that, when the ring-shaped portions are in the first position, the ring-shaped portions are attached to the outer wall of the cup body.

The attachment unit may be a double-sided tape so that a first side of the tape is attached to one of the pair of ring-shaped portions and a second side thereof is attached to the other one of the ring-shaped portions.

The ring-shaped portions each may include a plurality of wrinkle portions extending a radial direction of the through hole and formed in a circumferential direction of the through hole to enhance a strength of the ring-shaped portions.

According to the present invention, the pair of ring-shaped portions are attached to each other so that the shape of the hand grip may be stably maintained. Thus, the hand grip may be easily grasped so that the beverage accommodated in the paper cup is not shaken and overflow from the paper cup, and the pair of ring-shaped portions are not separated from each other so that the user may easily grasp the hand grip.

DETAILED DESCRIPTION OF THE INVENTION

Figure 1:
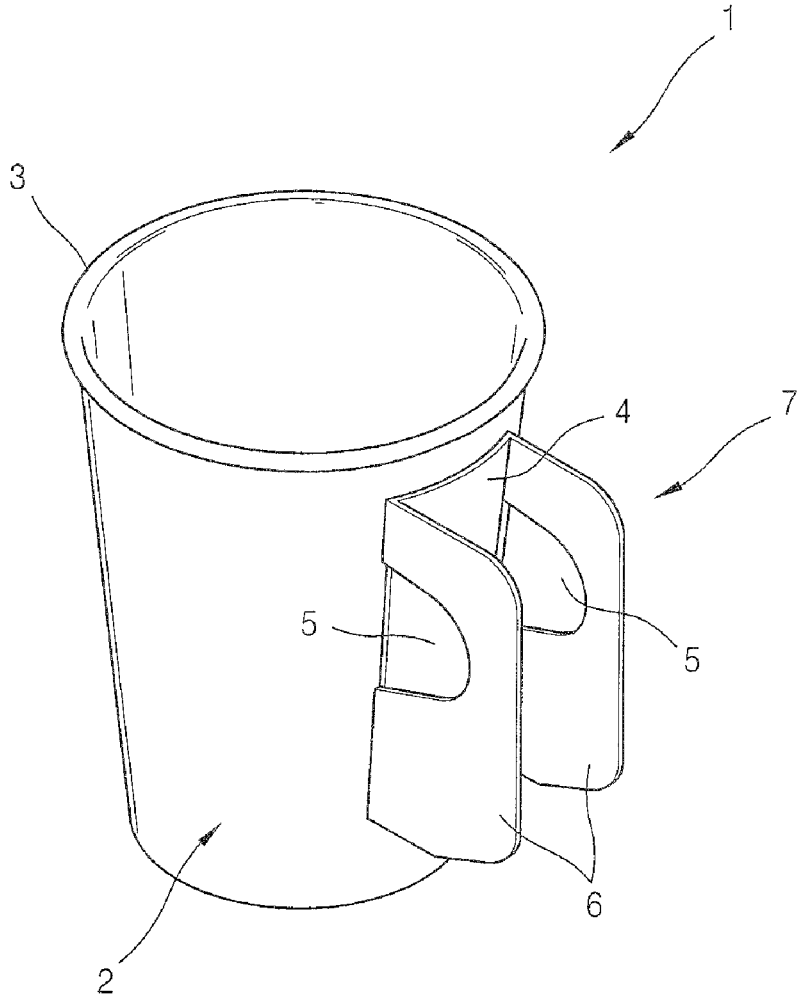
FIG. 1 (PRIOR ART)
FIG. 1 is a perspective view of a conventional paper cup with a hand grip.

In order to solve the above problems, a paper cup with a hand grip has been introduced. FIG. 1 illustrates a conventional paper cup 1 with a hand grip. The conventional paper cup 1 with the hand grip includes a cylindrical cup body 2 for accommodating a beverage, a curled portion 3 disposed at a top end of the cylindrical cup body 2 in order to protect the user's lips and maintaining the shape of the cup body 2, and a hand grip 7 symmetrically disposed along a vertical bending line and including a contact portion 4 attached to an outer wall of the cup body 2 and a pair of ring-shaped portions 6 each including a through hole 5 through which a user puts his/her finger when grasping the hand grip 7.

However, since ring-shaped portions 6 are separated from each other, the shape of the hand grip 7 is not stably maintained. Thus, when the user puts his/her finger in the through hole 5 of each of the ring-shaped portions 6 to grasp the hand grip 7, the ring-shaped portions 6 make a relative motion, and thus, a beverage accommodated in the paper cup 1 may be shaken and overflow from the conventional paper cup 1.

Also, when the user wants to grasp the paper cup 1 after putting it on a table, the user must first align the ring-shaped portions 6 that are separated from each other in order to put his/her finger in the through hole 5. In addition, when a plurality of paper cups 1 are stacked on the conventional paper cup 1 that has been already used, the hand grip 7 cannot be attached to the outer wall of the cup body 2 and the hand grip 7 may be caught in the top end of the conventional paper cup 1.

The present invention provides a paper cup with a hand grip, the paper cup accommodating a beverage and a user grasping the paper cup when drinking the beverage, the paper cup including: a cylindrical cup body of which upper end is opened and which accommodates the beverage poured from the opened upper portion; and the hand grip including a contact portion attached to an outer wall of the cup body and a pair of ring-shaped portions, wherein the pair of ring-shaped portions are symmetrically disposed on right and left ends of the contact portion and each include a through hole through which a user puts a finger when grasping the hand grip, wherein the pair of ring-shaped portions are movable between a first position where the ring-shaped portions are attached to the outer wall of the cup body and a second position where the hand grip is bent along the bending line formed at a boundary between the contact portion and the pair of ring-shaped portions so that the ring-shaped portions face each other, and the paper cup further including an attachment unit for attaching the pair of ring-shaped portions to each other when the pair of ring-shaped portions are in the second position, and wherein a groove portion is formed in a top end of the cup body, and protrusions are formed in top ends of the pair of ring-shaped portions, and the protrusions can be inserted in the groove portion so that, when the ring-shaped portions are in the first position, the ring-shaped portions are attached to the outer wall of the cup body.

Hereinafter, exemplary embodiments of the present invention will be described in detail with reference to the attached drawings.

Figure 2:
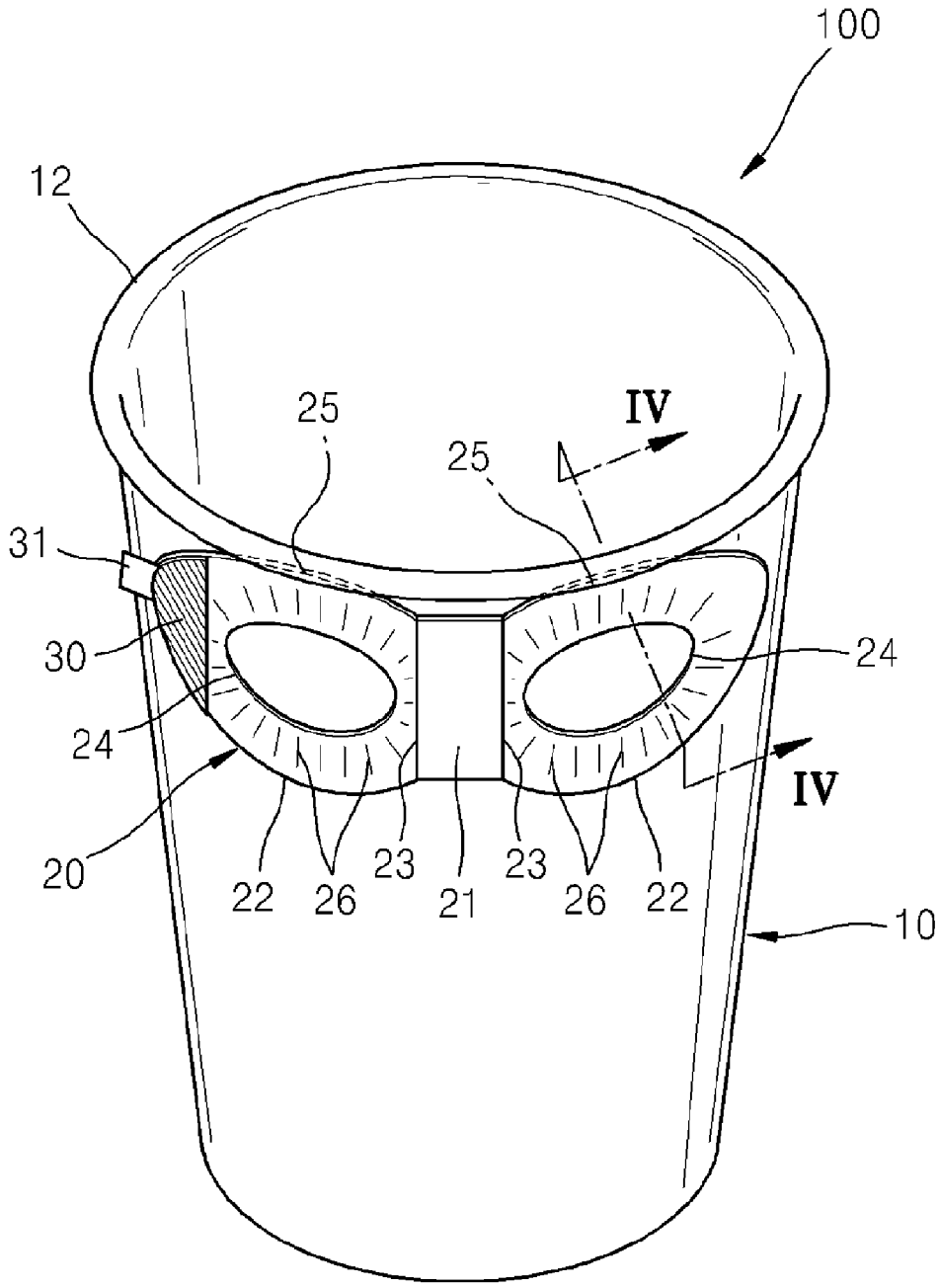
FIG. 2 is a perspective view of a paper cup with a hand grip according to an embodiment of the present invention.
Figure 3:
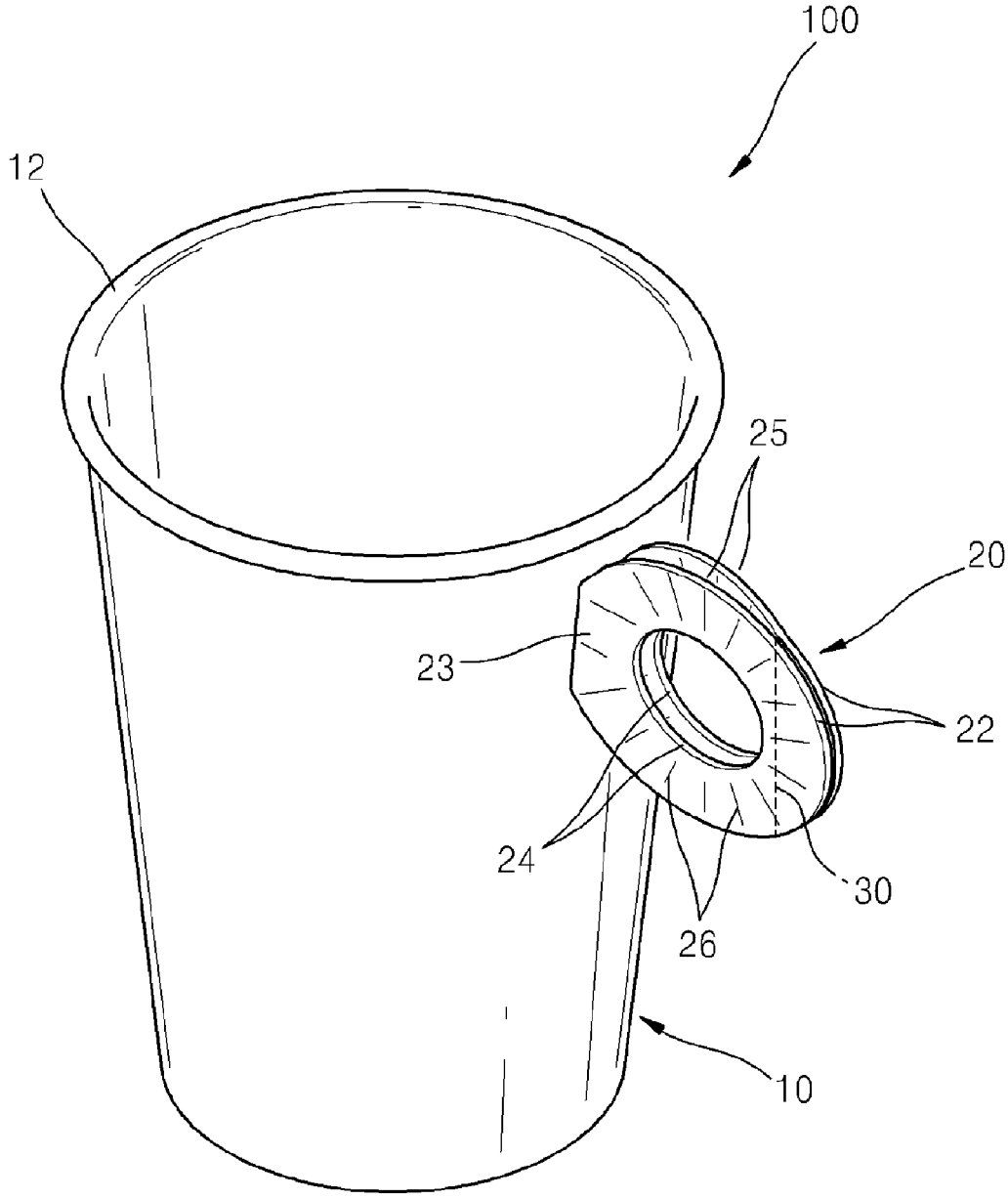
FIG. 3 is a perspective view of the paper cup with the hand grip of FIG. 2, wherein ring-shaped portions thereof are attached to each other on an outer wall of a cup body.
Figure 4:
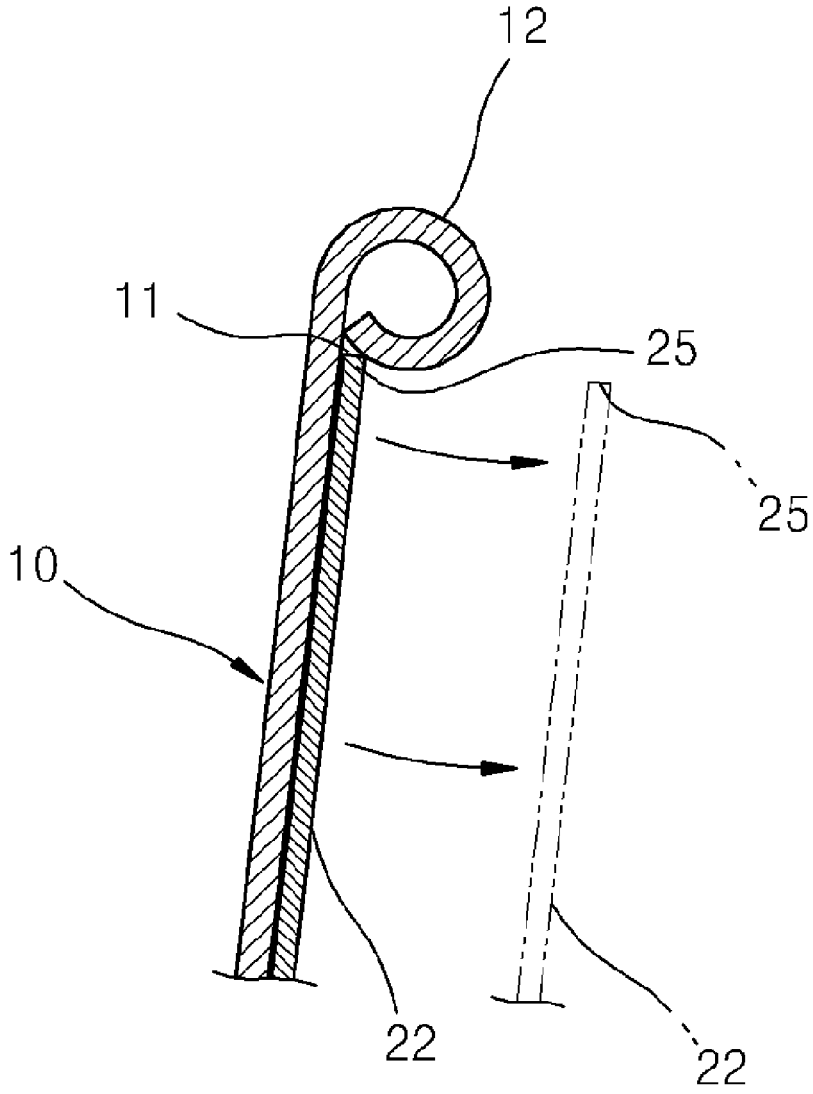
FIG. 4 is a cross-sectional view taken along line IV-IV of the paper cup with the handle grip of FIG. 2.

FIG. 2 is a perspective view of a paper cup with a hand grip according to an embodiment of the present invention, and FIG. 3 is a perspective view of the paper cup with the hand grip of FIG. 2, wherein ring-shaped portions thereof are attached to each other on an outer wall of a cup body, and FIG. 4 is a cross-sectional view taken along line IV-IV of the paper cup with the handle grip of FIG. 2.

Referring to FIGS. 2 through 4, a paper cup 100 with a hand grip according to the current embodiment of the present invention is used as a beverage accommodating container. The paper cup 100 includes a cup body 10, a hand grip 20, and an attachment unit.

The cup body 10 is a cylindrical container having an opened upper portion and may accommodate a beverage.

A curling portion 12 is disposed at a top end of the cup body 10 to protect user's lips and to maintain the shape of the cup body 10. The top end of the cup body 10 is rolled to the outside, thereby forming the curling portion 12.

A groove portion 11 is formed in the top end of the cup body 10. The groove portion 11 is formed by the curling portion 12 and an outer wall of the top end of the cup body 10.

The hand grip 20 is disposed so that a user can grasp the paper cup 100 and includes a contact portion 21 and a pair of ring-shaped portions 22.

The contact portion 21 is attached to the outer wall of the top end of the cup body 10 by using an adhesive, etc.

The ring-shaped portions 22 are oval members symmetrically disposed on right and left ends of the contact portion 21.

The ring-shaped portions 22 each include a through hole 24 through which a user puts his/her finger when grasping the paper cup 100.

A pair of bending lines 23 are vertically formed at a boundary between the contact portion 21 and the pair of ring-shaped portions 22.

The pair of ring-shaped portions 22 may be movable between a first position (shown in FIG. 2) where the ring-shaped portions 22 are attached to the outer wall of the cup body 10 and a second position (shown in FIG. 3) where the hand grip 20 is bent along the bending line 23 formed at the boundary between the contact portion 21 and the pair of ring-shaped portions 22 so that the ring-shaped portions 22 may face each other.

Protrusions 25 are formed at top ends of the ring-shaped portions 22. The protrusions 25 may be inserted in the groove portion 11 so that, when the ring-shaped portions 22 are in the first position, the ring-shaped portions 22 may be attached to the outer wall of the top end of the cup body 10. In the present embodiment, the top ends of the oval ring-shaped portions 22 serve as the protrusions 25.

In order to enhance the strength of the ring-shaped portions 22, the ring-shaped portions 22 each include a plurality of wrinkle portions 26 extending in a radial direction of the through hole 24 and formed in a circumferential direction of the through hole 24.

The attachment unit is used to attach the pair of ring-shaped portions 22 to each other on the outer wall of the cup body 10 when the pair of ring-shaped portions 22 are in the second position. In the present embodiment, a double-sided tape 30 is used as the attachment unit.

A first side of the double-sided tape 30 may be attached to one of the pair of ring-shaped portions 22, and a second side of the double-sided tape 30 may be attached to the other one of the ring-shaped portions 22. A separable protection layer 31 is formed on the other side of the double-sided tape 30 so as to prevent weakening of an adhesive force of the other side of the double-sided tape 30. The protection layer 31 includes a portion that protrudes from the outside of the ring-shaped portions 22 so that the user may easily strip the protection layer 31 from the double-sided tape 30.

Hereinafter, use of the paper cup 100 with the hand grip 20 having the above structure of FIG. 1 will be described.

When the paper cup 100 with the hand grip 20 is used, first, the protrusions 25 of the pair of ring-shaped portions 22 in the first position are pulled out from the groove portion 11.

The ring-shaped portions 22 detached from the groove portion 11 are bent along the bending lines 23 formed at the boundary between the contact portion 21 and the pair of ring-shaped portions 22 and are moved to the second position where the ring-shaped portions 22 face each other.

The protection layer 31 is separated from the other side of the double-sided tape 30, and the other side of the double-sided tape 30 is attached to the other one of the ring-shaped portions 22 so that the pair of ring-shaped portions 22 may be attached to each other, as illustrated in FIG. 3, and the user may use the paper cup 100 with the hand grip 20.

When the ring-shaped portions 22 are attached to each other by using the double-sided tape 30, even when the user grasps the ring-shaped portions 22 by putting a finger in the through hole 24, the ring-shaped portions do not make a relative motion. Thus, the shape of the hand grip 20 may be stably maintained. Thus, unlike the conventional paper cup 1 of FIG. 1, the hand grip 20 may be stably grasped so that the beverage accommodated in the paper cup 100 may be prevented from being shaken and overflowing from the paper cup 100.

Also, since the plurality of wrinkle portions 26 are disposed in the circumferential direction of the through hole 24, the structural strength of the ring-shaped portions 22 is enhanced. Thus, even when the user grasps the ring-shaped portions 22 by putting a finger in the through hole 24, the ring-shaped portions 22 may not be easily deformed, and the shape thereof may be stably maintained.

When the ring-shaped portions 22 are attached to each other by using the double-sided tape 30, even when the user grasps the paper cup 100 with the hand grip 20 again after putting it on a table, the pair of ring-shaped portions 22 are not separated from each other so that the user may easily grasp the hand grip 20 again.

Meanwhile, regarding the paper cup 100 with the hand grip 20, the protrusions 25 may be inserted in the groove portion 11 disposed in the top end of the cup body 10 so that the ring-shaped portions 22 may be attached to the outer wall of the cup body 10 before using the paper cup 100. Thus, even when a plurality of paper cups 100 with the hand grip 20 are stacked on a paper cup 100 with the hand grip 20 that has been already used, the ring-shaped portions 22 may be attached to the outer wall of the cup body 10, and unlike the conventional paper cup 1 of FIG. 1, the ring-shaped portions 22 may not be caught in the curling portion 12.

Also, even when a plurality of paper cups 100 with the hand grip 20 are stacked on a paper cup 100 with the hand grip 20 that has been already used and are accommodated in a beverage vending machine and then one paper cup 100 that is disposed in the lowermost portion of an inner space of the beverage vending machine is dropped and discharged, the protrusions 25 are inserted in the groove portion 11, and the ring-shaped portions 22 may be attached to the outer wall of the cup body 10. Thus, the ring-shaped portions 22 of the paper cup 100 that is disposed on the discharged paper cup 100 do not closely contact an inner wall of the cup body 10 of the discharged paper cup 100. Thus, a friction force between the stacked paper cups is lowered so that, like in the case of conventional paper cup 1 with no hand grip, the paper cup 100 with the hand grip 20 may be smoothly dropped and discharged.

When a paper cup 100 with the hand grip 20 that has been already used is stacked on a conventional paper cup collecting device, the ring-shaped portions 22 attached to each other on the outer wall of the cup body 10 by using the double-sided tape 30 are separated from each other and the protrusions 25 of the ring-shaped portions 22 are inserted in the groove portion 11, the hand grip 20 may not be caught in the paper cup collecting device.

In the present embodiment, the bending lines 23 are formed in advance. However, the present invention is not limited thereto, and the bending lines 23 may not be formed at all. When the bending lines 23 are formed in advance, the ring-shaped portions 22 may be easily bent based on the bending lines 23.

In the present embodiment, the top ends of the oval ring-shaped portions 22 serve as the protrusions 25. However, the present invention is not limited thereto, and portions that are formed by extending portions of the top ends of the oval ring-shaped portions 22 may serve as the protrusions 25 so that the ring-shaped portions 22 may be more easily attached to the outer wall of the cup body 10.

In the present embodiment, the protrusions 25 are inserted in the groove portion 11 so that the ring-shaped portions 22 may be attached to the outer wall of the cup body 10. However, by using a relatively small quantity of an adhesive, the ring-shaped portions 22 may be attached to the outer wall of the cup body 10.

In the present embodiment, the double-sided tape 30 is used as the attachment unit. However, the present invention is not limited thereto, and other units than the double-sided tape 30 may be used to attach the ring-shaped portions 22 to each other on the outer wall of the cup body 10.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper cup with a hand grip, the paper cup accommodating a beverage and a user grasping the paper cup when drinking the beverage, the paper cup comprising:

a cylindrical cup body of which upper end is opened and which accommodates the beverage poured from the opened upper portion; and the hand grip comprising a contact portion attached to an outer wall of the cup body and a pair of ring-shaped portions, wherein the pair of ring-shaped portions are symmetrically disposed on right and left ends of the contact portion and each comprise a through hole through which a user puts a finger when grasping the hand grip, wherein the pair of ring-shaped portions are movable between a first position where the ring-shaped portions are attached to the outer wall of the cup body and a second position where the hand grip is bent along the bending lines formed at a boundary between the contact portion and the pair of ring-shaped portions so that the ring-shaped portions face each other, and the paper cup further comprising an attachment unit for attaching the pair of ring-shaped portions to each other when the pair of ring-shaped portions are in the second position, and wherein a curling portion is formed by rolling the top end of the cup body, and a groove portion is formed by curling the portion and the outer wall of the top end of the cup body, and protrusions are formed in top ends of the pair of ring-shaped portions, and the protrusions can be inserted in the groove portion so that, when the ring-shaped portions are in the first position, the ring-shaped portions are attached to the outer wall of the cup body.

2. The paper cup of claim 1, wherein the attachment unit is a double-sided tape so that a first side of the tape is attached to one of the pair of ring-shaped portions and a second side thereof is attached to the other one of the ring-shaped portions.

3. The paper cup of claim 1, wherein the ring-shaped portions each comprise a plurality of wrinkle portions extending in a radial direction of the through hole and formed in a circumferential direction of the through hole to enhance a strength of the ring-shaped portions.

* * * * *